United States Patent [19]

Thomsen et al.

[11] 3,950,920

[45] Apr. 20, 1976

[54] COLLECTING SYSTEM FOR BATCHWISE COLLECTION OF ROD-SHAPED OBJECTS

[75] Inventors: Jorgen Thyrsted Thomsen; Aage Juul, both of Fredericia, Denmark

[73] Assignee: J. P. Schmidt Jun. A/S, Fredericia, Denmark

[22] Filed: Feb. 28, 1974

[21] Appl. No.: 446,776

[30] Foreign Application Priority Data

Feb. 28, 1973 Denmark ..... 1076/73

[52] U.S. Cl. ..... 53/59 R; 53/236; 214/17 CA

[51] Int. Cl.[2] ..... B65G 1/08

[58] Field of Search ..... 214/17 C, 17 CA; 198/44, 47, 69; 131/21 A, 25; 53/236, 59 R

[56] References Cited

UNITED STATES PATENTS

| | | | |
|---|---|---|---|
| 2,767,536 | 10/1956 | Forkel | 53/236 |
| 3,062,393 | 11/1962 | Bond | 214/17 CA |
| 3,355,004 | 11/1967 | Rupert | 214/17 CA X |
| 3,535,847 | 10/1970 | Strohmeier et al. | 53/59 R |
| 3,596,797 | 8/1971 | Wallenborn | 214/17 CA X |

FOREIGN PATENTS OR APPLICATIONS

| | | | |
|---|---|---|---|
| 1,545,986 | 10/1968 | France | 214/17 CA |

*Primary Examiner*—Robert G. Sheridan
*Attorney, Agent, or Firm*—Finnegan, Henderson, Farabow & Garrett

[57] ABSTRACT

A collecting system for batchwise collection of rod-shaped objects, such as cigars and cheroots, having a collecting band releasably suspended at one end and the other end being located between a roller and spring loaded counterbacking whereby the band defines between the two ends a downwardly closed and upwardly open receptacle. A duct for feeding the rod-shaped objects communicates with the opening of the receptacle. A driver is connected with the roller and a control device is provided for ascertaining the presence of the rod-shaped objects at the upper part of the receptacle and for controlling the driver in such a manner as to gradually increase the length of the receptacle-defining band when objects are positioned above a predetermined level.

5 Claims, 1 Drawing Figure

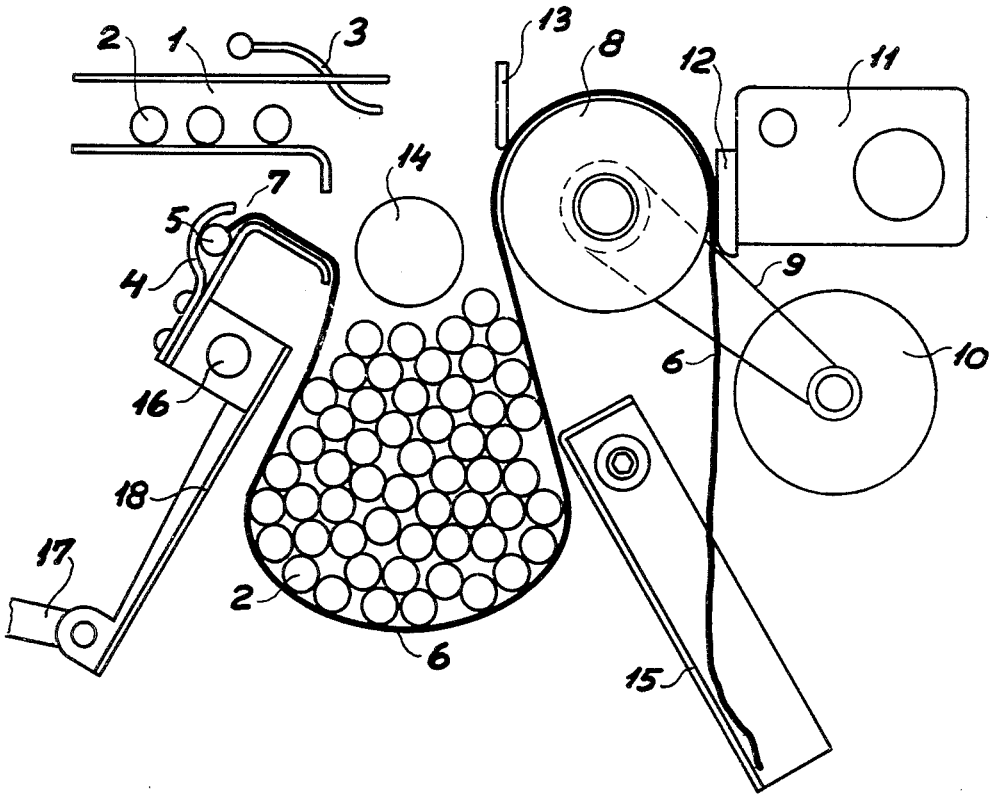
2
1
3
13
8
12
11
14
7
5
4
9
10
6
16
18
17
2
6
15

COLLECTING SYSTEM FOR BATCHWISE COLLECTION OF ROD-SHAPED OBJECTS

This invention relates to a collecting system for batchwise collection of rod-shaped objects, particularly cigars and cheroots. In the manufacture of cigars and cheroots and other rod-shaped objects it is the general practice to collect the objects in batches which are then passed on to a subsequent step in the manufacturing process, and where the objects are relatively fragile it is significant for this collection to be made in a particularly expedient manner and previously it was therefore usually carried out manually.

It is the aim of the present invention to provide a collecting system in which the collection is performed entirely automatically and includes a counting of the objects, but which at the same time ensures that no damage will be caused to the objects when they are deposited on top of each other in the receptacle.

The said operational and precautionary advantages have been achieved by the collecting system of the invention, which comprises a collecting band releasably attached at one end and downwardly defining a receptacle communicating with a feeding duct adjacent to whose opening into the receptacle there is provided means, such as for instance a photocell arrangement, for ascertaining the presence of objects and where the length of the collecting band defining the receptacle can be increased by a driving member controlled by the said means and driving an advancing roller for the band that is retained between the said advancing roller and a weight or spring loaded counterbacking. As a result of this construction the band supporting the objects is maintained in a position where the distance from the point where the objects are fed and to the band or to the objects already deposited thereon is constantly kept at a minimum, so that the objects will drop only a very short distance and thus cause no damage to each other. The photocell arrangement ensures that the band will be lowered slightly as soon as it has been filled enough to activate the photocell arrangement, which controls the band advancing motor. When the desired number of objects have been collected in the band receptacle the band may be removed from the system.

To ensure that the objects are guided accurately towards the band on their leaving the feeding duct there is mounted a barrier screen vis-a-vis the feeding duct on the opposite side the said photocell arrangement.

To facilitate removal and insertion of the collecting band the band may be secured at one end to a stop rod and carried through a slit which is narrower than the thickness of the rod and disposed below the feeding duct. The band may have a length corresponding to a single batch and may be removed and inserted again when the batch has been delivered, but it may also be a continuous belt which is severed for each batch.

To facilitate the counting of the objects a counting arrangement of any convenient type may be mounted at the exit of the feeding duct.

To ensure that the objects are deposited correctly, i.e. in parallel relationship, the system may be provided on either side of the receptacle formed by the band but outwardly of the band with a boundary wall of which at least one is pivotable about an axis at the upper end of the wall and connected to a driving member for periodical oscillation of the wall. The oscillating wall will cause minor displacements of the objects deposited on the band and cause them to subside into a proper position. Moreover the band driving motor may be reversed to advance the band in the opposite direction whereby the system bay be used for carrying the objects out of the receptacle and advance them gently upwards into the feeding duct.

The invention will be described in greater detail below with reference to the drawing, which presents a view in side elevation of the essential numbers of a collecting system according to the invention.

The drawing shows a system comprising a feeding duct 1 through which for instance cheroots 2 may be introduced and pass under an easily movable arm 3 which actuates a counting device. Immediately adjacent to the opening of the feeding duct is provided a holder 4 in which is inserted a rod 5 to which is secured a band 6 which passes out through a slit 7 in the holder 4. The band 6 extends downwardly to form a loop for receiving a plurality of cheroots 2 and is carried upwards over a roller 8 which is driven through a belt 9 by a motor 10. The band 6 is maintained in engagement with the roller 8 by means of a counterweight 11 with a smooth facing 12 against which the band 6 will slide. Closely adjacent to the roller 8 is further provided a screen 13 which serves to prevent the cheroots passing over the roller 8, and between the roller 8 and the holder 4, that is closely adjacent to the opening of the feeding duct 1 and immediately above the receptacle formed by the band 6 and containing cheeroots 2 there is an electric eye 14, which may be a conventional light source above which is mounted a photocell which in generally known manner serves to control the operation of the motor 10. As soon as the receptacle has received so many cheroots that they cover the electric eye 14 the motor will start and carry the band forward to enlarge the receptacle and when the cheroots have been lowered so much that the electric eye is free the motor will stop. The counting device is connected to a finger 3 and may be adapted in conventional manner to issue an alarm signal or to automatically stop the feeding of cheroots when a predetermined number has been supplied. On either side of the band receptacle is a wall, 18 and 15 respectively. Both walls are downwardly diverging, wall 15 being fixed and wall 18 being pivotable about an axis 16 by means of a draw bar 17 connected to the lower end of the wall. The draw bar can be reciprocated in any desired manner, not shown in the drawing, so as to impart a periodical reciprocating movement to the wall 15, which thus serves to push the cheroots 2 into position in the receptacle and ensure that they will be deposited accurately. When the desired number of cheroots have been fed into the receptacle formed by the band, the band may be removed by drawing the rod 5 out of the holder 4 in axial direction, on which the band 6 can be readily removed from the roller 8 by raising the counterweight 11 out of contact with the band. The band may have a length corresponding to a single batch, or it may be a continuous belt which is severed at the end of each operation.

What we claim is:

1. A collecting system for batchwise collection of rod-shaped objects, particularly cigars and cheroots, said collecting system comprising a collecting band releasably suspended at one end; a roller; means for rotating said roller; counterbacking means located adjacent to said roller for receiving the other end of said collecting band therebetween, said counterbacking means being biased toward said roller for retaining said other end to form a portion of said band between said releasably suspended end and retained end into a downwardly closed and upwardly open receptacle; a duct communicating with the upwardly open portion of said receptacle for feeding the rod-shaped objects into said receptacle; means for ascertaining the presence of the rod-shaped objects at the upwardly open portion of said receptacle and for controlling said rotating means for increasing the length of said receptacle-defining portion of said band when the rod-shaped objects in said receptacle are above a predetermined level; boundary walls on each side of said receptacle outwardly of said collecting band, at least one of said boundary walls being pivotally mounted at its upper end; and driving means for periodic oscillation of said pivotally mounted boundary walls.

2. The collecting system according to claim 1, further including a counting device positioned in said feeding duct for counting the rod-shaped objects being fed to said receptacle.

3. The collecting system according to claim 1, wherein said means for rotating said roller is reversible.

4. The collecting system according to claim 1, further including a barrier screen vis-a-vis the feeding duct between said ascertaining and control means and said roller for guiding the rod-shaped objects into said receptacle.

5. The collecting system according to claim 1 further including a stop rod secured to said releasably suspended end of said collecting band and means disposed below the feeding duct having a slit narrower than the thickness of said stop rod for accepting and carrying said stop rod.

* * * * *